United States Patent [19]

Strobel

[11] Patent Number: 4,465,007

[45] Date of Patent: Aug. 14, 1984

[54] EMBROIDERY FABRIC

[76] Inventor: Louise Strobel, 120 Coral Way, Clarksville, Ind. 47130

[21] Appl. No.: 437,315

[22] Filed: Oct. 28, 1982

[51] Int. Cl.[3] ..... D05C 17/00; D03D 1/00; D03D 9/00

[52] U.S. Cl. ..... 112/439; 112/266.1; 139/383 R; 139/416

[58] Field of Search ..... 139/416, 383 R, 407; 112/439, 402, 266.1; 28/168, 170

[56] References Cited

U.S. PATENT DOCUMENTS 2,272,229 2/1942 Tucker ..... 139/383 R
2,697,455 12/1954 Williams ..... 139/383 R
2,797,712 7/1957 Shapiro ..... 139/383 R
3,779,190 12/1973 Hower ..... 112/266.1
4,154,181 5/1979 Massucci et al. ..... 112/439 X

FOREIGN PATENT DOCUMENTS 2297277 8/1976 France ..... 28/168

*Primary Examiner*—James Kee Chi
*Attorney, Agent, or Firm*—Brady, O'Boyle & Gates

[57] ABSTRACT

An embroidery fabric having colored guide threads forming a grid corresponding to the heavy grid lines on conventional embroidery paper patterns, the guide threads being removed from the fabric when the embroidery work has been completed.

1 Claim, 5 Drawing Figures

FIG. 1
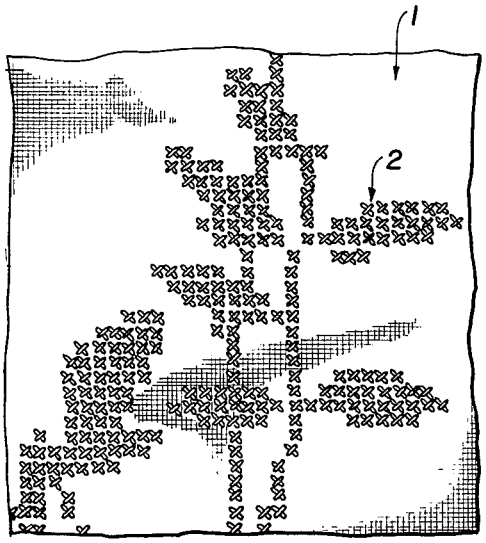
FIG. 2
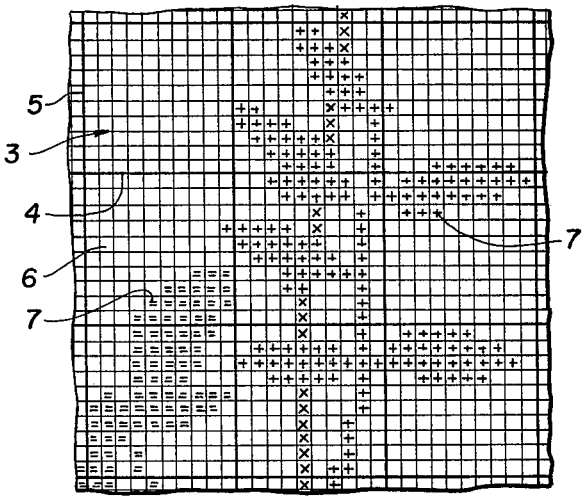
FIG. 3
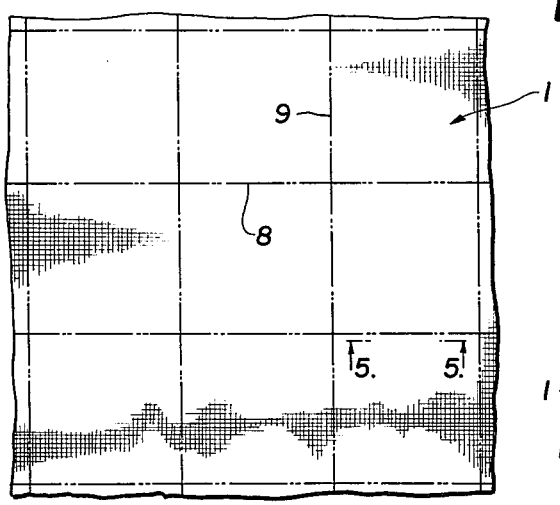
FIG. 4
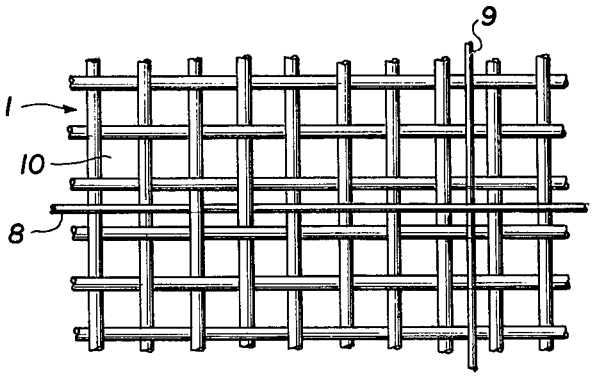
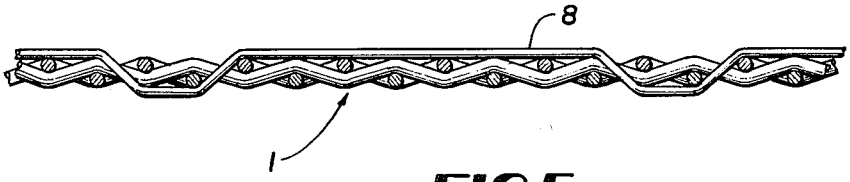
FIG. 5

EMBROIDERY FABRIC

BACKGROUND OF THE INVENTION

Fabric employed in counted cross stitch embroidery consists of loosely, even woven threads; that is, the same number and size threads going both crosswise and lengthwise per square inch. This fabric provides a true square when cross stitch embroidery is used across the same number of threads in each direction, usually two across and two up and down. A needle and embroidery thread or yarn are employed to provide a decoration on the fabric which, itself, is attractive and need not be entirely covered by the embroidery yarn or thread.

Conventional patterns for counted thread cross stitch embroidery are printed on paper having a grid printed thereon similar to graph paper wherein horizontal and vertical heavy lines define blocks containing one hundred small squares, ten squares horizontally and ten squares vertically. Different symbols are printed in the various squares denoting different colored threads to be employed in the fabric. Patterns may be small and simple or large and complicated requiring many different shades and colors of thread or yarn. A completely filled block of one hundred squares requires the needle to enter and leave the fabric at least two hundred times. Many decorative pictures will have many blocks, some filled completely and others filled partially, in random patterns. Using the correct color thread in the precise correct small square is a tedious process. Heretofore, an embroiderer had to start the embroidery work at a selected point along one side of the fabric. All subsequent stitches were made in relation to the previous ones by counting squares on the paper pattern and then threads of the fabric.

To overcome the tedious process of transferring the information contained on the paper pattern to the use of the proper colored thread at the correct location on the fabric, it has been proposed to superimpose a pattern sheet on the fabric and then embroider the fabric by inserting the needle and colored yarn through the pattern and fabric. After the work is completed, the pattern is removed from the fabric. This proposal has not been universally accepted since it is difficult to keep the pattern aligned with the proper squares in the fabric while performing the work, and when removing the pattern, there is a tendency to loosen or tear the colored yarn from the embroidered fabric.

To overcome the disadvantages experienced in previous embroidery methods, the fabric of the present invention has been devised which comprises, essentially, a conventional loosely woven, even-weave fabric having horizontally and vertically disposed colored guide threads woven therein in such a manner to correspond to the heavier lines on the conventional paper pattern forming a grid of blocks each having one hundred small squares contained therein. By this construction and arrangement, the fabric can be embroidered more easily since the grid structure formed by the colored guide threads facilitates the determination whether a particular pattern will fit on a piece of fabric, and also facilitates the use of the same color of thread or yarn in the various groups or blocks in the pattern before using another color of yarn or thread. After the embroidery is completed, the colored guide threads forming the grid are removed from the fabric.

BRIEF DESCRIPTION OF THE DRAWING

FIG. 1 is a fragmentary top plan view of an embroidered fabric;

FIG. 2 is a fragmentary top plan view of a conventional paper pattern;

FIG. 3 is a fragmentary top plan view of the fabric of the present invention;

FIG. 4 is an enlarged, fragmentary, top plan view of the fabric of the present invention; and FIG. 5 is a view taken along line 5—5 of FIG. 3.

DESCRIPTION OF THE PREFERRED EMBODIMENT

Referring to the drawings and more particularly to FIG. 1 thereof, an embroidery fabric 1 is shown having a cross stitch 2 of colored yarn or thread thereton to provide a decoration. The conventional fabric is loosely woven and even weave; that is, the fabric has the same number and size threads going both crosswise and lengthwise per square inch.

In order that the proper colored yarn or thread 2 is stitched into the fabric 1 at the proper location, a conventional paper pattern 3 is employed as shown in FIG. 2. The paper pattern is similar to graph paper wherein horizontal lines 4 and vertical lines 5 define blocks containing one hundred small squares 6, ten squares horizontally and ten squares vertically. Some of the squares contain indicia or symbols 7 denoting the different colored threads 2 to be employed in the fabric 1. In the illustrated example, the symbol + indicates the use of pale blue green, × indicates the use of light green, and = indicates the use of green. Those skilled in the art know that these are standard symbols used in embroidery work and that other standard symbols are used for other colors in this example. Employing the information contained on the paper pattern 3 for using the correct color thread 2 in the precise correct small square in the fabric 1 is a tedious process since the embroiderer is required to select a point along one side of the fabric 1 to start the embroidery work and all subsequent stitches 2 were made in relation to the previous ones by counting the squares 6 in the paper pattern 3 and then threads in the fabric 1.

To overcome this tedious process, the embroidery fabric of the present invention has been devised as shown in FIGS. 3, 4 and 5, and comprises the conventional embroidery fabric 1 as shown and described in connection with FIG. 1; however, the fabric is provided with guide threads 8 and 9 extending horizontally and vertically, respectively. The guide threads 8 and 9 are woven into the fabric 1 in such a manner to correspond to the heavier lines 4 and 5 on the paper pattern 3 to thereby form a grid of blocks each having one hundred small squares 10 contained therein.

By this construction and arrangement, the fabric 1 can be embroidered more easily since the grid structure formed by the colored guide threads 8, 9 facilitate the determination whether a particular pattern will fit on a piece of fabric 1, and also facilitates the use of the same color of thread or yarn 2 in the various groups or blocks in the pattern before using another color. After the embroidery is completed, the guide threads 8 and 9 are removed from the fabric to provide an embroidered fabric as shown in FIG. 1.

While the fabric of the present invention has been described wherein the guide threads 8 and 9 are woven into the fabric 1 to form a grid of blocks each having one hundred small squares 10, it will be appreciated that the guide threads 8 and 9 can be woven into the fabric to form a grid of blocks containing any number of squares 10, such as two hundred or four hundred.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In an embroidery fabric having loosely, even woven relatively thick threads, the improvement comprising, vertically and horizontally extending relatively thin guide threads woven into said fabric in such a manner to correspond to the heavier lines on a conventional embroidery paper pattern, to thereby form a grid of blocks containing a predetermined number of open squares in the fabric, said guide threads being of a different color from the threads of said fabric and being removable from the fabric upon completion of the embroidery work, thereby removing any trace of the grid blocks from the fabric.

* * * * *